United States Patent [19]

Flanagan

[11] B 3,982,070

[45] Sept. 21, 1976

[54] PHASE VOCODER SPEECH SYNTHESIS SYSTEM

[75] Inventor: James Loton Flanagan, Warren, N.J.

[73] Assignee: Bell Telephone Laboratories, Incorporated, Murray Hill, N.J.

[22] Filed: June 5, 1974

[21] Appl. No.: 476,577

[44] Published under the second Trial Voluntary Protest Program on January 20, 1976 as document No. B 476,577.

[52] U.S. Cl. ..... 179/1 SM

[51] Int. Cl.[2] ..... G10L 1/00

[58] Field of Search ..... 179/1 SA, 1 SM

[56] References Cited

UNITED STATES PATENTS

| | | | |
|---|---|---|---|
| 3,360,610 | 12/1967 | Flanagan | 179/1 SA |
| 3,369,077 | 12/1967 | French | 179/1 SA |
| 3,450,838 | 6/1969 | Bandat | 179/1 SA |
| 3,828,132 | 8/1974 | Flanagan et al. | 179/1 SA |

OTHER PUBLICATIONS

Flanagan, J. and Golden, R., "Phase Vocoder," Bell Syst. Tech. J., Nov. 1966.

*Primary Examiner*—Kathleen H. Claffy
*Assistant Examiner*—E. S. Kemeny
*Attorney, Agent, or Firm*—G. E. Murphy; H. L. Logan; R. O. Nimtz

[57] ABSTRACT

Disclosed is a system for synthesizing speech from stored signals representative of words precoded in accordance with phase vocoder techniques. The stored signals comprise short-time Fourier transform parameters which describe the magnitude and phase derivative of the short-time signal spectrum. Speech synthesis is achieved by extracting the stored signals of chosen words under control of a duration factor signal, by concatenating the extracted signals, by operating on the phase derivative parameters to effect a desired speech pitch change, by interpolating the magnitude parameters of the short-time Fourier transform in response to the pitch and duration changes, and by decoding the resultant signals in accordance with phase vocoder techniques.

15 Claims, 5 Drawing Figures

PHASE VOCODER SPEECH SYNTHESIS SYSTEM

BACKGROUND OF THE INVENTION

This invention relates to apparatus for forming and synthesizing natural sounding speech.

The use of phase vocoder techniques in the fields of speech transmission and frequency bandwidth reduction has been disclosed in U.S. Pat. No. 3,360,610, issued to me on Dec. 26, 1967. Therein, a communication arrangement is described in which speech signals to be transmitted are encoded into a plurality of narrow band components which occupy a combined bandwidth narrower than that of the unencoded speech. Briefly summarized, phase vocoder encoding is performed by computing, at each of a set of predetermined frequencies, $\omega_i$, which span the frequency range of an incoming speech signal, a pair of signals respectively representative of the real and the imaginary parts of the short-time Fourier transform of the original speech signal. From each pair of such signals there is developed a pair of narrow band signals; one signal $|S_i|$, representing the magnitude of the short-time Fourier transform, and the other signal, $\dot{\phi}_i$, representing the time derivative of the phase angle of the short-time Fourier transform. In accordance with the above communication arrangement, these narrow band signals are transmitted to a receiver wherein a replica of the original signal is reproduced by generating a plurality of cosine signals having the same predetermined frequencies at which the short-time Fourier transform was evaluated. Each cosine signal is then modulated in amplitude and phase angle by the pairs of narrow band signals, and the modulated signals are summed to produce the desired replica signal.

J. P. Carlson, in a paper entitled "Digitalized Phase Vocoder," published in the Proceedings of the 1967 *Conference on Speech Communication and Processing*, pages 292–296, describes the digitizing of the narrow band signals $|S_i|$ and $\dot{\phi}_i$ before transmission, and indicates that at a 9600 bit/second transmission rate, for example, the degradation due to digitization of the parameters is unnoticeable in the reconstructed speech signal.

In a separate field of art, many attempts have been made to synthesize natural sounding speech from stored speech signals by the use of formant coding of phonemes (or words) into stored signals. One such apparatus is disclosed in my U.S. Pat. No. 3,828,132 issued Aug. 6, 1974. These systems are generally satisfactory, but when pitch and duration control capability is required, as it is when contextual constraints of the synthesized speech are strong, these systems become complex and require lengthy computations.

Accordingly, it is an object of this invention to provide a system for synthesizing natural sounding speech.

It is a further object of this invention to provide means for synthesizing speech wherein speech pitch and duration are effectively controlled.

It is a still further object of this invention to synthesize speech from stored signals of vocabulary words encoded in accordance with phase vocoder techniques.

SUMMARY OF THE INVENTION

These and other objects of the invention are achieved by encoding vocabulary words into a plurality of short-time speech amplitude signals and short-time phase derivative signals, by converting the encoded signals into a digital format, and by storing the digital encoded signals in a memory. Natural sounding speech is formed and synthesized by withdrawing from memory stored signals corresponding to the desired words, by concatenating the withdrawn signals, and by modifying the duration and pitch of the concatenated signals. Duration control is achieved by inserting between successively withdrawn different signals a predetermined number of interpolated signals. This causes an effective slowdown of the speech, controlled by the number of interpolated signals inserted. Control of pitch is achieved by multiplying the phase derivative signals by a chosen factor. Speech synthesis is completed by converting the modified signals from digital to analog format and by decoding the signals in accordance with known phase vocoder techniques.

DETAILED DESCRIPTION

Figure 1:
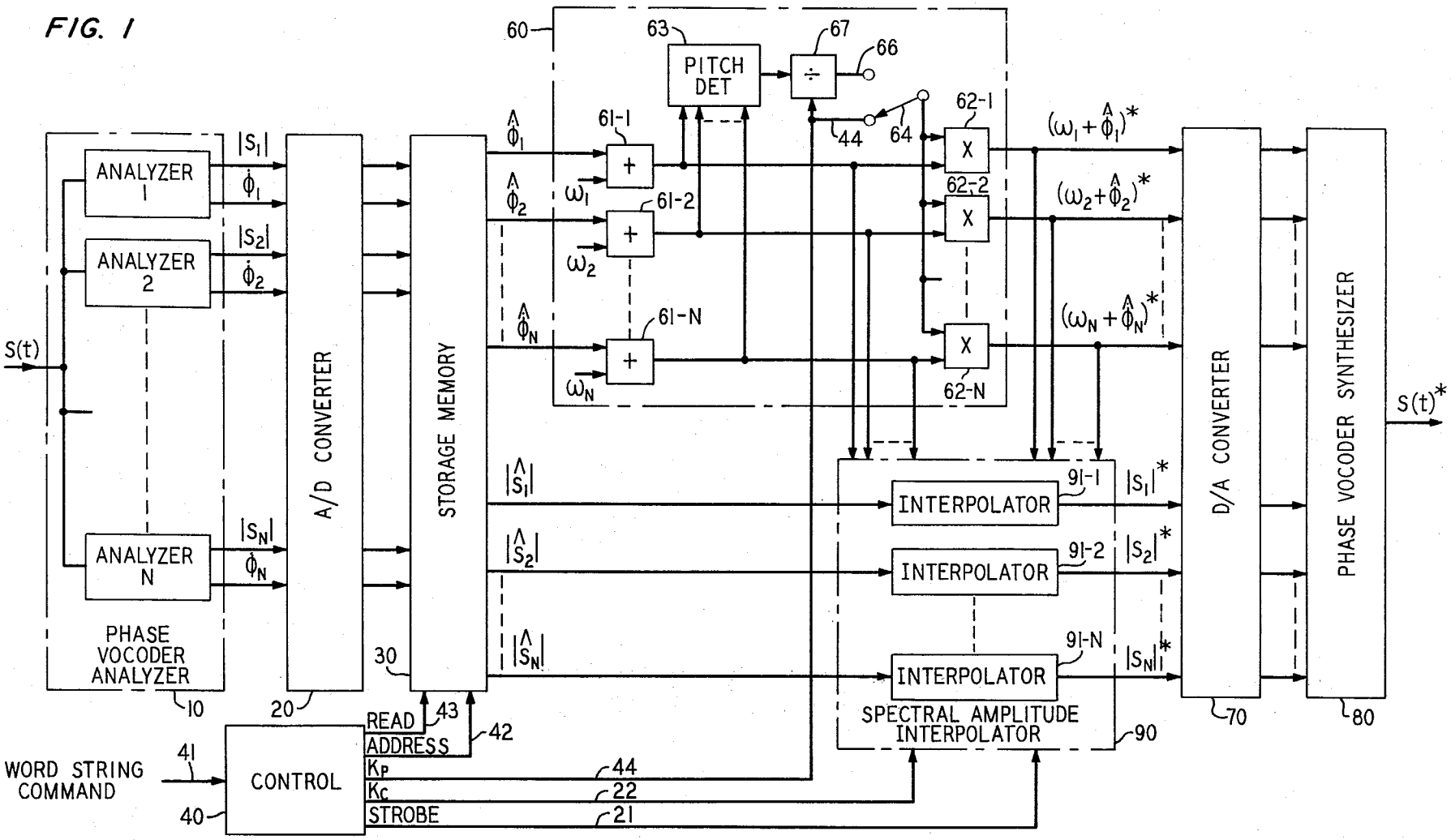
FIG. 1 depicts a schematic block diagram of a speech synthesis system in accordance with this invention.

FIG. 1 illustrates a schematic block diagram of a speech synthesis system wherein spoken words are encoded into phase vocoder control signals, and wherein speech synthesis is achieved by extracting proper description signals from storage, by concatenating and modifying the description signals, and by decoding and combining the modified signals into synthesized speech signals.

More specifically, the vocabulary of words which is deemed necessary for contemplated speech synthesis is presented to phase vocoder analyzer 10 of FIG. 1 for encoding. Analyzer 10 encodes the words into a plurality of signal pairs, $|S_1|, \dot{\phi}_1; |S_2|, \dot{\phi}_2; \ldots |S_i|, \dot{\phi}_i, \ldots |S_N|, \dot{\phi}_N$, constituting an $|S|$ vector and a $\dot{\phi}$ vector, where each $|S_i|$ and $\dot{\phi}_i$, respectively represent the short-time amplitude spectrum, and the short-time phase derivative spectrum of the speech signal determined at a spectral frequency $\omega_i$. The analyzing frequencies, $\omega_i$, are spaced uniformly or nonuniformly throughout the frequency band of interest as dicated by design criteria. The bandwidth necessary to transmit the $S_i$ and $\dot{\phi}_i$ is small compared to the speech bandwidth. Phase vocoder analyzer 10 may be implemented as described in the aforementioned Flanagan U.S. Pat. No. 3,360,610.

Following encoding by analyzer 10, the $|S|$ and $\dot{\phi}$ analog vectors are sampled and converted to digital format in A/D converter 20. Converter 20 may be implemented as described in the aforementioned Carlson paper, generating 160 bits at a sampling rate of 60 Hz, and thereby yielding an overall bit rate of 9600 bits per second. The converted signals are stored in storage memory 30 of FIG. 1, and are thereafter available for the synthesis process. Since each word processed by analyzer 10 is sampled at a rate of 60 Hz, and since the duration of each word is longer than 16 msec, each processed word is represented by a plurality of $|S|$ vectors and associated $\phi$ vectors. These vectors may be inserted into memory 30 in a sequential manner in a dedicated block of memory. Within the block of memory, each pair of $|S|$ and $\phi$ vectors is stored in one memory location, and each memory location is subdivided and made to contain the components $|S_i|$ and $\phi_i$ of each vector.

Speech synthesis is achieved by formulating and presenting a string of commands to device 40 of FIG. 1 via lead 41. The string of commands dictates to the system the sequence of words which are to be selected from memory 30 and which are to be concatenated to form a speech signal. Accordingly, selected blocks of memory are accessed sequentially, and within each memory block all memory locations are accessed sequentially. Each memory location presents to the output of memory 30 a pair of $|S|$ and $\phi$ vectors. In accordance with this invention, control device 40 decodes the input command string into memory 30 addresses and applies the addresses and appropriate READ commands to the memory. Additionally, based on the sequence of words dictated, device 40 analyzes the word string structure and assigns duration and pitch values $K_d$ (internal to device 40) and $K_p$, respectively, for each accessed memory location, to provide for natural sounding speech having pitch and duration which is dependent on the word string structure. A detailed description of control device 40 is hereinafter presented.

Duration Control

Figure 2:
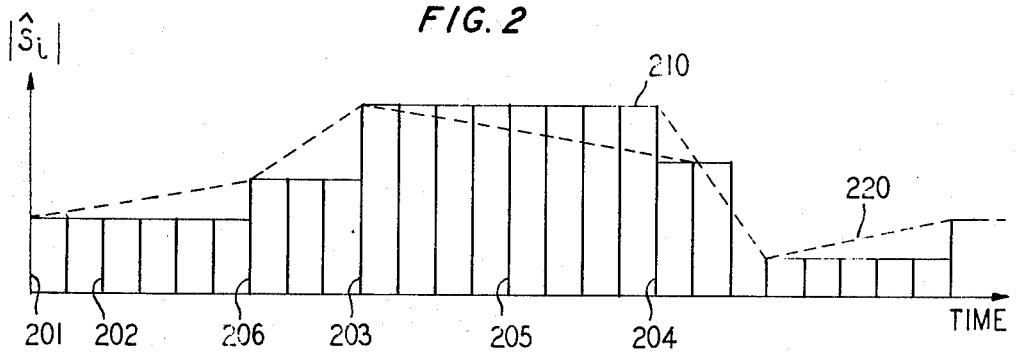
FIG. 2 illustrates the short-time amplitude spectrum of the $i^{th}$ spectrum signal $|S_i|$ at the output of the storage memory 30 of FIG. 1.

Duration control may be achieved by repeated accessing of each selected memory location at a fixed high frequency clock rate, and by controlling the number of such repeated accesses. In this manner, speech duration can effectively be increased by increasing the number of times each memory is accessed. For example, if the input speech is sampled at a 60 Hz rate, as previously mentioned, the memory may advantageously be accessed at a 6KHz rate (which might equal the Nyquist rate of the final synthesized signal), and the nominal number of accesses for each memory address may be set at 100. Such operation would result in a faithful reproduction of the speech duration of the signal as applied at the input of the system. It is apparent, of course, that repeated accessing of each memory location of more than 100 times causes a slowdown in the synthesized speech or stretches the time scale, and repeated accessing of less than 100 times causes a speedup in the synthesized speech or a contraction of the time scale. The exact number of times that each memory address (specified by the signal on lead 42) is accessed is dictated by control circuit 40 via repeated READ commands on lead 43. The above approach to speech duration control is illustrated in FIG. 2 which depicts the amplitude of a particular $|\hat{S}_i|$ component as it varies with time. The designation $|\hat{S}|$ (with the added $\wedge$ symbol) represents the vector S at the output of memory 30. In FIG. 2, element 201 represents the value of $|\hat{S}_i|$ at a particular time as it appears at the output of memory 30 in response to the accessing of a particular memory location, $v$. Element 201 is the first accessing of the $v^{th}$ memory location. Element 202 also represents the value of $|\hat{S}_i|$ at location v, but it is the third time that the location $v$ is accessed. Element 206 represents the value of $|\hat{S}_i|$ at the next memory location, $v+1$, and it represents the initial accessing of location $v+1$. If, for example, location $v+1$ is the last location of a memory block, then element 203 represents the value of $|\hat{S}_i|$ at an initial accessing of a first memory location, $u$, of a new memory block (beginning a new word). Locations $v$ and $u$ may, of course, be substantially different. Element 205 also represents the value of $|\hat{S}_i|$ at location $u$, but at a subsequent accessing time, and element 204 represents the final accessing of memory location $u$. The number of times a memory location is accessed is dictated by the duration control $K_d$ (internal to control block 40 — see FIG. 5) which, through the $K_c$ signal, controls a spectral amplitude interpolator 90 in FIG. 1. Only the $i^{th}$ component of the $|\hat{S}|$ vector at the output of memory 30 is illustrated in FIG. 2. Other components of the $|\hat{S}|$ vector and the components of the $\hat{\phi}$ vector have, of course, different values, but the break points due to changes in memory location within a memory block (e.g., time element 206) or due to changes of memory location from one memory block to another (e.g., time of element 205) occur at the same instants of time.

Figure 3:
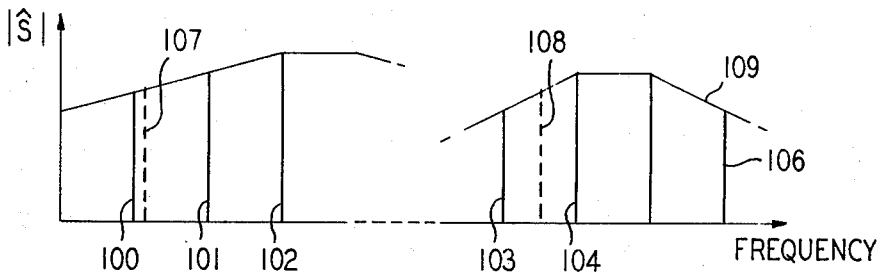
FIG. 3 illustrates the overall speech spectrum at a particular instant and the effect of pitch variations on the signal's spectral amplitudes.

This can easily be appreciated if on a three dimensional space, as commonly defined by $x$, $y$, and $z$ coordinates, the $|\hat{S}|$ vector with all its components is visualized or drawn. Each component's variation with time may be drawn on a plane defined by the $x$ and $y$ coordinates, with the $x$ axis indicating time (as shown on FIG. 2), and for any selected $x$ axis value, the plane defined by the $y$ and $z$ coordinates may depict the various $|\hat{S}|$ vector components, and the general instantaneous shape of the spectrum (as shown in FIG. 3, which is hereinafter described). With such a three dimensional drawing, the abrupt changes in the $|\hat{S}|$ vector (which occur at a particular time) are contained within a single $y$-$z$ plane.

Pitch Control

In an article entitled "Phase Vocoder," by J. L. Flanagan et al, *Bell System Technical Journal*, Vol. 45, No. 9, p. 1493, November 1966, it is shown that the $\hat{\phi}$ vector is closely related to the pitch of an analyzed speech signal when the analyzing bandwidth of the phase vocoder is narrow compared to the total speech bandwidth. In view of the above, and in accordance with this invention, a change in pitch is accomplished by forming and modifying an $(\omega + \hat{\phi})$ vector signal which comprises the elements $(\omega_1 + \hat{\phi}_1)$, $(\omega_2 + \hat{\phi}_2)$, . . . $(\omega_i + \hat{\phi}_i)$ . . . $(\omega_N + \hat{\phi}_N)$. The modification may consist of multiplying the $(\omega + \hat{\phi})$ vector by a pitch variation parameter, $K_p$. Thus, when $K_p$ is greater than 1, the pitch of the synthesized speech is increased, and when $K_p$ is less than 1, the pitch of the synthesized speech is decreased.

The pitch alteration is accomplished in device 60 of FIG. 1. Device 60 comprises an adder circuit **61-*i* dedicated to each $\hat{\phi}_i$ for adding a corresponding $\omega_i$ signal to each $\hat{\phi}_i$ signal, and a multiplier circuit 62-i dedicated to each $\hat{\phi}_i$ for multiplying the output signal of each adder with the pitch variation control signal, $K_p$. The signal $K_p$ is connected to lead 44 and is applied to multipliers 62 through switch 64. Digital adders 61 and digital multipliers 62** are simple digital circuits which are well known in the art of electronic circuits.

In an alternative approach to pitch control in accordance with the invention, the $K_p$ factor supplied by control device 40 in FIG. 1 may specify the actual pitch desired to be synthesized rather than the pitch variation. In such a case, the pitch of the synthesized speech signal derived from storage memory 30 must be ascertained, and an internal pitch multiplicative factor must be computed. Accordingly, device 60 further comprises a pitch detector 63, responsive to the $(\omega + \hat{\phi})$ vector, which computes the actual pitch attributable to the speech signals derived from memory 30. Pitch detectors are well known in the art; one embodiment of which is disclosed by R. L. Miller in U.S. Pat. No. 2,627,541, issued Feb. 3, 1953. Divider circuit 67 in element 60 computes the internal multiplicative factor by dividing the desired pitch, $K_p$, by the computed pitch signal. The computed multiplicative factor is applied to multipliers 62 through switch 64 connected to lead 66. Divider 67 is a simple digital divider which may comprise, for example, a read-only-memory (ROM) responsive to the output signal of pitch detector 63, providing the inverse of the pitch signal, and a multiplier, similar to multiplier 62, for multiplying the ROM output signal with the desired pitch signal, $K_p$, thereby developing the desired multiplicative factor.

The output signal of element 60 is a $(\omega + \hat{\phi})^*$ signal vector, which is a duration and pitch modified replica of a $(\omega + \hat{\phi})$ signal vector. (It is duration modified because both $|\hat{S}|$ and $\hat{\phi}$ vectors at the output of memory 30 are duration modified.) This vector, coupled with an interpolated duration modified $|S|^*$ vector, hereinafter described is applied to D/A converter 70 which converts each of the digital signals in the two signal vectors to analog format. The analog signals are then applied to a phase vocoder synthesizer 80 to produce a signal representative of the desired synthesized speech. Phase vocoder 80 may be constructed in essentially the same manner as disclosed in the aforementioned Flanagan U.S. Pat. No. 3,360,610.

Spectrum Shape Interpolation

FIG. 3 illustrates the amplitudes of the components of the $|\hat{S}|$ vector at a particular instant. Element 100 corresponds to the the $|\hat{S}_1|$ signal, element 101 corresponds to the $|\hat{S}_2|$ signal, element 103 corresponds to the $|\hat{S}_i|$ signal, element 104 corresponds to the $|\hat{S}_{i+1}|$ signal, and so on. Element 106, for example, may represent the $|\hat{S}_N|$ signal. The frequencies at which these signals appear are $(\omega_1 + \hat{\phi}_1)$, $(\omega_2 + \hat{\phi}_2)$, . . . $(\omega_i + \hat{\phi}_i)$, $(\omega_{i+1} + \hat{\phi}_{i+1})$, and $(\omega_N + \hat{\phi}_N)$, respectively. Viewed in the visualized three dimensional space as described above, the S vector drawing of FIG. 3 would be the two dimensional cross-section of the three dimensional space positioned in parallel to the plane defined by the $y$ and $z$ axes.

When the $(\omega + \hat{\phi})$ vector is altered in device 60 to form the $(\omega + \hat{\phi})^*$ signal vector, the frequency of each member of the $|\hat{S}|$ signal vector is concomitantly shifted as indicated in FIG. 3, for example, by shifted elements 107 and 108. It is apparent from FIG. 3 that if element 108 is to be made to conform (as shown) to the spectrum envelope of FIG. 3 (curve 109), it is necessary to modify the amplitude of element 103 from which element 108 is derived. Accordingly, the amplitude of element 103 must be multiplied by a constant which is derived from the ratio of the amplitudes of elements 104 and 103. It can be shown that this constant, $K_x$, can be computed by evaluating $$K_x = \frac{\left[(\omega_{i+1}+\hat{\phi}_{i+1})-(\omega_i+\hat{\phi}_i)^*\right] + \left|\frac{\hat{S}_{i+1}}{\hat{S}_i}\right| \left[(\omega_i+\phi_i)^*-(\omega_i+\phi_i)\right]}{(\omega_i+\hat{\phi}_{i+1}) - (\omega_i+\hat{\phi}_i)} \qquad (1)$$

Additionally, from a perusal of FIG. 2, it appears that the staircase time envelope of the synthesized spectrum, curve 210, can be smoothed out; and it is intuitively apparent that such smoothing out of the spectrum's envelope results in more pleasing and more natural sounding speech. The envelope smoothing can be done by "fitting" a polynomial curve for each $|\hat{S}_i|$ component over the initial $|\hat{S}_i|$ values when a new memory address is accessed, e.g., a curving fitting over elements 201, 206, and 203, and by altering the repeated $|\hat{S}_i|$ signals to fit within that curve. This, however, is a complex mathemetical task which requires the aid of special-purpose computing circuitry or a general purpose computer. For purposes of clarity, the more simple, straight line interpolation approach is described. This interpolation curve is illustrated by curve 220 in FIG. 2. Thus, the S vector whose frequency components may be visualized on one plane and whose time variations may be visualized on a second plane can be interpolated to simultaneously react to variations in both time and frequency (pitch).

Accordingly, if element 203 is designated as $S_i^{m}$, defining the $|\hat{S}_i|$ signal at time $m_1$, element between is designated $S_i^{m_2}$, and element 205 is designated as $S_i^{m_x}$. It can be shown that the interpolated amplitude of element 205, "fitting" curve 220, can be computed by evaluating $$\frac{S_i^{m_2} - S_i^{m_1}}{m_2 - m_1}(m_x - m_1) + S_i^{m_1}, \qquad (2)$$

and after taking account of the $K_x$ factor of equation (1), the final amplitude of element 205 can be computed by evaluating $$K_x \left[(S_i^{m_2} - S_i^{m_1}) \frac{m_x - m_1}{m_2 - m_1} + S_i^{m_1}\right]. \qquad (3)$$

Thus, by evaluating equation (3), each $S_i$ element at the output of memory 30 and at a particular time instant may be modified to account for the pitch and duration changes, to produce a spectrum which yields natural sounding speech.

It should be noted that in accordance with the duration control approach of this invention, device 40 in FIG. 1 generates a number of control signals, one of which corresponds to the signal $$\frac{m_x - m_1}{m_2 - m_1}.$$

That signal is designated

Figure 4:
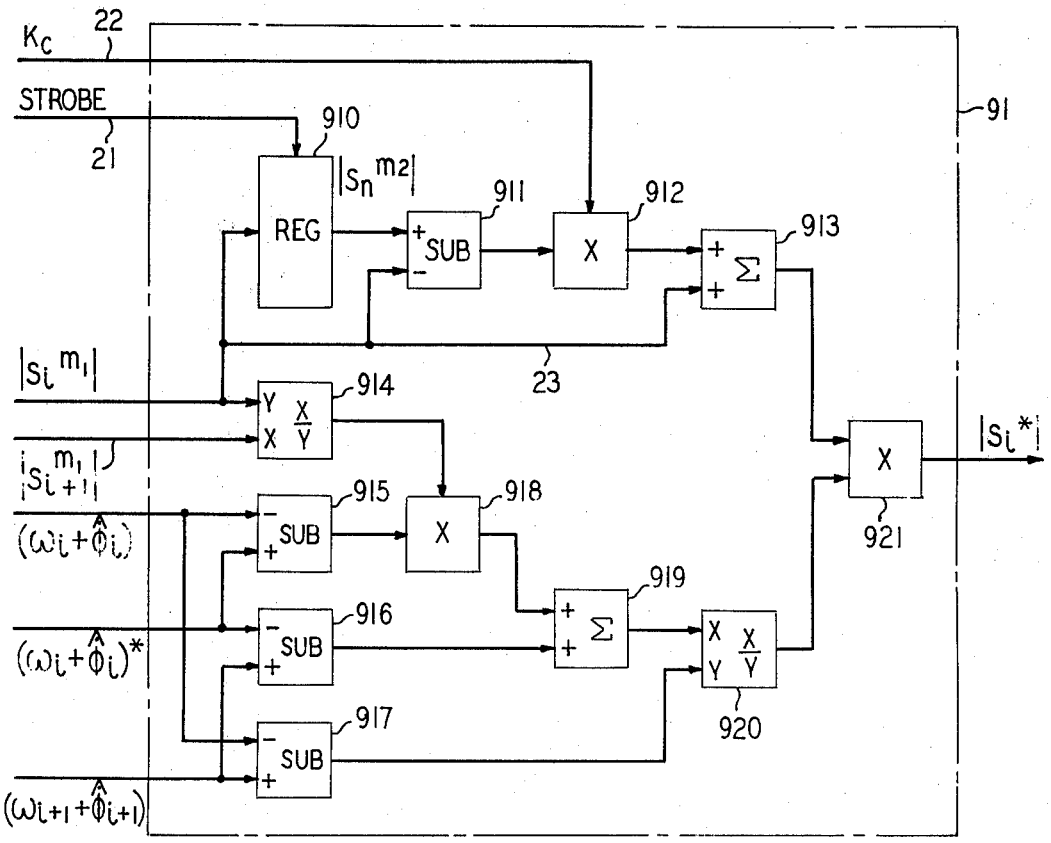
FIG. 4 depicts a block diagram of the interpolator circuit of FIG. 1.

To provide for the above-described "smoothing out" of the synthesized spectrum's envelope in time and in frequency, FIG. 1 includes a spectrum amplitude interpolator 90, interposed between memory 30 and analog converter 70. Interpolator 90 may simply be a short-circuit connection between each $|\hat{S}_i|$ input and its corresponding interpolated $|\hat{S}_i|^*$ output. This corresponds to a simple "box-car" or constant interpolation in the time plane, yielding a spectrum envelope as shown by curve 210 in FIG. 2, and no interpolation at all in the frequency plane. On the other hand, interpolator 90 may comprise a plurality of interpolator 91 devices embodied by highly complex special purpose or general purpose computers, providing a sophisticated cruved fitting capability. FIG. 4 illustrates an embodiment of interpolator 91 for the straight line interpolation approach defined by equation (3).

The interpolator 91 shown in FIG. 4 is the $i^{th}$ interpolator in device 90, and is responsive to two spectrum signals of the initial memory accessing of the present memory address, signals $|S_i^{m_1}|$ and $|S_{i+1}^{m_1}|$ ; to the spectrum signal of the next memory address, $|S_i^{m_2}|$ ; to the $i^{th}$ unaltered and altered frequencies, $(\omega_i+\phi_1)$ and $(\omega_i+\hat{\phi}_i)^*$, respectively; and to the $(i+1)^{th}$ unaltered frequency $(\omega_{i+1}+\hat{\phi}_{i+1})$. Thus, when a new memory 30 address is accessed and the $|S_i^{m_1}|$ and $|S_{i+1}^{m_2}|$ signals are obtained, control device 40 also addresses the next memory location and provides a strobe pulse (on lead 21) to strobe the next signal, $|S_i^{m_2}|$ , into register 910 of FIG. 4. Consequently, substractor 911 is responsive to $|S_i^{m_2}|$ , from register 910, and to $|S_i^{m_1}|$, on lead 23. The intermediate signal defined by equation (2) is computed by multiplier 912 which is responsive to substractor 911 and to the aforementioned 2 $K_c$ factor on lead 22, and by summer 913 which is responsive to multiplier 912 output signal and to the $|S_i^{m_1}|$ signal on lead 23. The multiplicative factor $K_x$ is computed by elements 914, 915, 916, 917, 918, 919, and 920. Divider 914 is responsive to $|S_i^{m_2}|$ and to $S_{i+1}^{m_1}|$ , developing the signal $$\frac{|S_{i+1}|}{|S_i|}$$

of equation (1). Substractor circuits 915, 916, and 917 develop the signals $|(\omega_i+\hat{\phi}_i)^* - (\omega_i+\hat{\phi}_i)|$, $|(\omega_{i+1}+\hat{\phi}_{i+1}) - (\omega_i+\hat{\phi}_i)^*|$ , and $|(\omega_{i+1}+\hat{\phi}_{i+1}) - (\omega_i+\hat{\phi}_i)|$ , respectively, and multiplier 918, responsive to circuits 914 and 915, generates the product signal $$\frac{|\hat{S}_{i+1}|}{|S_i|} \quad (\omega_i+\hat{\phi}_i)^* - (\omega_i+\hat{\phi}_i)$$

Lastly, summer 919, responsive to elements 916 and 918 and divider 92., divides the output signal of summer 919 by the output signal of subtractor 917, developing a signal representative of the constant $K_x$ in accordance with equation (1). Finally, multiplier 921, responsive to summer 913 and to divider 920, generates the interpolated signal, $|S_i|^*$.

Description of Control Device 40

Figure 5:
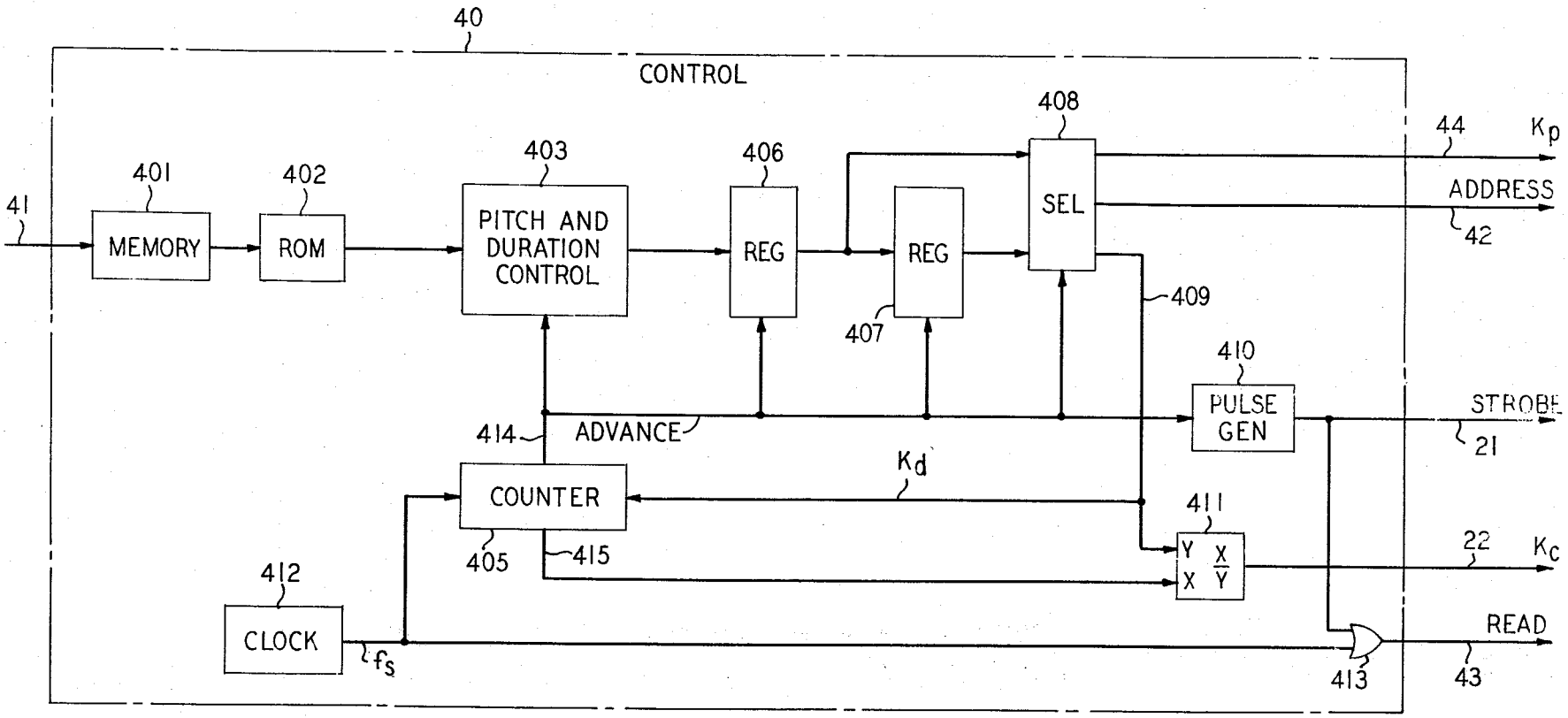
FIG. 5 depicts an embodiment of the control circuit 40 of FIG. 1.

FIG. 5 depicts a schematic block diagram of the control circuit of FIG. 1 — device 40. In accordance with this invention, device 40 is responsive to a word string command signal on lead 41 which dictates the message to be synthesized. The input string of commands is stored in memory 401, and thereafter is applied to a read-only-memory 402 (ROM) wherein the string of commands is decoded into the proper address sequence for memory 30 of FIG. 1. The ROM decoding is performed in accordance with apriori knowledge of the storage location of particular words in memory 30. The desired word sequence, as dictated by the input command string, may be analyzed to determine the desired pitch and duration based on positional rules, syntax rules, or any other message dependent rules. For purposes of illustration only, FIG. 5 includes means for analyzing and formulating the desired pitch and word duration for the synthesized speech based on the syntax of the synthesized speech. The analysis apparatus, designed pitch and duration control 403, is shown in FIG. 5 to be responsive to ROM 402 and to an advance signal on lead 414. Apparatus for analyzing speech based on syntax and for assigning pitch and durations is disclosed by Coker et al, U.S. Pat. No. 3,704,345, issued Nov. 28, 1972. FIG. 1 of that patent depicts a pitch and intensity generator 20, a vowel duration generator 21, and a consonant duration generator 22; all basically responsive to a syntax analyzer 13. These generators provide signals descriptive of the desired pitch, intensity, and duration associated with the phonemes specified in each memory address to be accessed. For the purposes of this invention, instead of a phoneme dictionary 14 of Coker, a word dictionary may be used, and the vowel or consonant generators of Coker may be combined into a unified pitch and duration generator. Accordingly, FIG. 5 depicts the pitch and duration control circuit 403 which generates an output containing a memory address field, a pitch control field, $K_p$, and a duration control field, $K_d$. The output signal of pitch and duration control circuit 403 is stored in register 406. The output signal of register 406 is applied to a register 407. Accordingly, when register 407 contains a present memory address, register 406 is said to contain the next memory address. Both registers are connected to a selector circuit 408 which selects and transfers the output signals of either of the two registers to the selector's output.

The number of commands for accessing each memory location is controlled by inserting the $K_d$ number at the output of selector 408, on lead 409, into a down-counter 405. The basic memory accessing clock, $f_s$, generated in circuit 412, provides pulses which "count down" counter 405 while the memory is being accessed and read through OR gate 413 via lead 43. When counter 405 reaches zero, it develops an advance signal pulse on lead 414. This signal advances circuit 403 to the next memory state, causes register 406 to store the next memory state, and causes register 407 to store the new present state. Simultaneously, under command of the advance signal, selector 408 presents to leads 44 and 42 the contents of register 406, and pulse generator 410 responsive to the advance signal provides an additional READ command to memory 30 through OR gate 413. The output pulse of generator 410 is also used, via strobe lead 21, to strobe the output signal of memory 30 into register 910 in device 91, thus storing in register 90 the signals $S_i^{m_2}$, described above. When the advance signal on lead 414 disappears, selector 408 switches register 407 output signal to the output of the selector, and on the next pulse from clock 412 a new $K_d$ is inserted into counter 405.

The state of counter 405 at any instant is indicated by the signal on lead 415. That signal represents the quantity $m_x-m_1$. The constant $K_d$, which appears as the input signal to counter 405 (lead 409), represents the quantity $m_2-m_1$. Accordingly, the constant $K_c$ is computed by divider 411, which divides the signal on lead 415 by the signal on lead 409.

A careful study of the principles of the invention disclosed herein would reveal that, under certain circumstances, a computer program embodiment of this invention is possible, and may prove to be advantageous in certain respects. For example, if a prospective user of the speech synthesizing system of this invention finds it desirable to use a very complex spectrum interpolation approach, it may prove more feasible to use a computer embodiment for interpolator 90 of FIG. 1 rather than a specially designed apparatus. Once a computer is included in the system, however, some additional features may be incorporated in the computer, thereby reducing the amount of special hardware required. For example, the arithmetic operations involved in the pitch detection and the pitch alteration apparatus are quite simple, and any computer programs which are necessary for implementing the pitch control function are straightforward and well known to those skilled in the art. Similarly, memory 30 may be incorporated into the computer, as can the phase vocoder analyzer and most of the phase vocoder synthesizer. A computer implementation for the phase vocoder analyzer and synthesizer was, in fact, utilized by Carlson in the aforementioned paper. Reference is also made to the computer simulation of a phase vocoder described in the aforementioned "Phase Vocoder" article, on page 1496.

I claim:

1. Apparatus for synthesizing a natural sounding speech message from phase vocoder stored signals representative of a vocabulary of words comprising:

means for selectively extracting preselected locations of said stored signals for constructing a predetermined sequence of signals representative of said speech message;

means for altering the pitch parameters of said extracted signals; and means for combining said pitch modified signals.

2. Apparatus for synthesizing a natural sounding speech message comprising:

means for storing phase vocoder signals representative of a vocabulary of words;

first means, responsive to an applied duration control signal, for selectively extracting from said means for storing preselected signals to form a duration modified sequence of signals representative of said speech message;

means for altering the pitch parameters of said extracted signals; and means for combining said signals modified in pitch and duration to form a sum signal for activating a speech synthesizer.

3. Apparatus for generating natural sounding synthesized speech comprising:

a memory for storing phase vocoder encoded signals representative of a vocabulary of words;

means for extracting signals from selected storage locations of said memory to affect the duration of said synthesized speech;

means for altering the pitch parameters of said extracted signals to affect the pitch of said synthesized speech; and means for phase vocoder decoding of said altered signals to form said synthesized speech signal.

4. A system for synthesizing speech messages from phase vocoder encoded word signals stored in a memory comprising:

means for extracting selected signals from said memory a repeated number of times to affect the duration of said speech messages;

means for altering the pitch parameters of said extracted signals; and means for decoding said pitch and duration altered signals to form said speech messages.

5. A system for composing speech messages from phase vocoder encoded and stored words comprising:

means for extracting selected signals from said encoded stored words a repeated number of times to affect the duration of said composed speech;

means for altering the pitch parameters of said extracted signals;

means for interpolating the spectrum parameters of said extracted signals; and means for decoding said interpolated and pitch altered signals to form a composed speech message signal.

6. Apparatus for synthesizing natural sounding speech comprising:

a phase vocoder analyzer responsive to an applied vocabulary of words;

means for storing the output signals of said analyzer;

means for extracting the signals of selected storage locations in said means for storing;

means for modifying the pitch parameters of said extracted signals; and means for converting said pitch modified signals in accordance with phase vocoder techniques to develop a natural sounding speech signal.

7. Apparatus for processing phase vocoder type representations of selected prerecorded spoken words to form a description of a desired message suitable for actuating a speech synthesizer to develop synthesized speech, which comprises:

first means, for encoding said prerecorded words in accordance with phase vocoder techniques to form short-time Fourier transform signal vectors and phase derivative signal vectors;

second means, for storing said phase derivative and said short-time Fourier transform signal vectors;

third means, for extracting selected locations of said stored signals a preselected number of times of control the duration of said synthesized speech;

fourth means, for modifying said phase derivative signal vectors to control the pitch of said synthesized speech;

fifth means, for interpolating the shorttime Fourier transform signal vectors in accordance with predetermined rules responsive to an applied duration control signal and to the modified phase derivative signal vectors to effect a smooth spectrum envelope; and sixth means, for combining said modified phase derivative signal vector and said spectrum interpolated short-time Fourier transform signal vector in accordance with phase vocoder techniques to form a synthesized speech signal suitable for actuating said speech synthesizer.

8. The apparatus defined in claim 7 wherein said fourth means comprises:

seventh means, for adding to each phase derivative signal an appropriate corresponding frequency signal; and eighth means, for multiplying each of said added signals by an applied pitch control signal.

9. The apparatus defined in claim 7 wherein said fourth means comprises:

seventh means, for adding to each phase derivative signal an appropriate frequency signal to form a pitch signal vector;

eighth means, for ascertaining the true pitch of said pitch signal vector;

ninth means, responsive to an applied pitch control signal and to said eighth means for computing a pitch alteration multiplicative factor; and tenth means for multiplying each of said added signals with said multiplicative factor.

10. The apparatus defined in claim 7 wherein said fifth means comprises:

means for modifying each component of said short-time Fourier transform signal vectors to account for the pitch and duration modifications in adjacent components of said short-time Fourier transform signal vectors.

11. Apparatus for processing phase vocoder type representations of selected prerecorded spoken words to form a description of a desired message suitable for actuating a speech synthesizer to develop synthesized speech, which comprises:

first means, for encoding said prerecorded words in accordance with phase vocoder techniques to form short-time Fourier transform signal vectors and phase derivative signal vectors;

second means, for storing said phase derivative and said short-time Fourier transform signal vectors;

third means, for extracting selected locations of said stored signals a preselected number of times to control the duration of said synthesized speech;

fourth means, for modifying said phase derivative signal vectors to control the pitch of said synthesized speech; and fifth means, for combining said modified phase derivative signal vector and said duration controlled short-time Fourier transformed signal vector in accordance with phase vocoder techniques to form a synthesized speech signal suitable for actuating said speech synthesizer.

12. A method for synthesizing a natural sounding speech message from phase vocoder stored signals representative of a vocabulary of words comprising the steps of:

selectively extracting preselected locations of said stored signals for the construction of a predetermined sequence of signals representative of said speech message;

altering the pitch parameters of said extracted signals; and combining said pitch modified signals.

13. A method for synthesizing a natural sounding speech message comprising the steps of:

storing phase vocoder signals representative of a vocabulary of words;

selectively extracting from said stored signals preselected signals forming a duration modified predetermined sequence of signals representative of said speech message;

altering the pitch parameters of said extracted signals; and combining said pitch and function modified signals to form a sum signal for activating a speech synthesizer.

14. A method for composing speech message from phase vocoder encoded and stored words comprising the steps of:

extracting selected signals from said encoded stored words a repeated number of times to affect the duration of synthesized speech;

altering the pitch parameters of said extracted signals;

interpolating the spectrum parameters of said extracted signal; and phase vocoder decoding of said interpolated and pitch and duration altered signals to form a speech message signal.

15. A method for processing phase vocoder type representations of selected prerecorded spoken words to form a description of a desired message suitable for actuating a speech synthesizer to develop synthesized speech, which comprises the steps of:

encoding said prerecorded words in accordance with phase vocoder techniques to form short-time Fourier transform signal vectors and phase derivative signal vectors;

storing said phase derivative and said short-time Fourier transform signal vectors;

extracting selected locations of said stored signals a preselected number of times to control the duration of said synthesized speech;

modifying said phase derivative signal vectors to control the pitch of said synthesized speech;

interpolating the short-time Fourier transform signal vectors in accordance with predetermined rules responsive to an applied duration control signal and to the modified phase derivative signal vectors to effect a smooth spectrum envelope; and combining said modified phase derivative signal vectors and said spectrum interpolated shorttime Fourier transform signal vectors in accordance with phase vocoder techniques to form a synthesized speech signal suitable for actuating said speech synthesizer.

* * * * *